US005754923A

United States Patent [19]

Yang

[11] Patent Number: 5,754,923

[45] Date of Patent: May 19, 1998

[54] IMAGE FORMING APPARATUS WITH CONTROLLED WARMUP AND RELATED METHOD

[75] Inventor: Seung-Sik Yang, Seoul, Rep. of Korea

[73] Assignee: SamSung Electronics Co., Ltd., Kyungki-do, Rep. of Korea

[21] Appl. No.: 732,912

[22] Filed: Oct. 17, 1996

[30] Foreign Application Priority Data

Oct. 20, 1995 [KR] Rep. of Korea ..... 1995/36344

[51] Int. Cl.[6] ..... G03G 15/06

[52] U.S. Cl. ..... 399/70; 399/13

[58] Field of Search ..... 399/13, 27, 70, 399/262; 219/216

[56] References Cited

U.S. PATENT DOCUMENTS

| | | | |
|---|---|---|---|
| 4,951,090 | 8/1990 | Matsumoto et al. | 399/13 |
| 5,105,218 | 4/1992 | Ikeda et al. | 399/27 |
| 5,122,837 | 6/1992 | Sonoda et al. | 399/12 |
| 5,184,181 | 2/1993 | Kurando et al. | 399/262 |
| 5,289,242 | 2/1994 | Christensen et al. | 399/12 |
| 5,398,106 | 3/1995 | Eguchi | 399/110 |
| 5,471,282 | 11/1995 | Hayashi et al. | 399/64 |
| 5,475,469 | 12/1995 | Okada et al. | 399/27 |
| 5,589,923 | 12/1996 | Lee et al. | 399/70 X |

*Primary Examiner*—Arthur T. Grimley
*Assistant Examiner*—Quana Grainger
*Attorney, Agent, or Firm*—Robert E. Bushnell, Esq.

[57] ABSTRACT

A warmup of an image forming apparatus is controlled with a first sensor for detecting if a cover of the apparatus is being opened or not and a second sensor for detecting if a toner cartridge of the apparatus is moved or not. The control involves the steps of: when the first sensor produces a signal informing the cover is being opened, determining if the toner cartridge is moved in response to the signal; and allowing the image forming apparatus to go through a warmup only when the second sensor produces a signal informing the movement of the toner cartridge.

19 Claims, 3 Drawing Sheets

IMAGE FORMING APPARATUS WITH CONTROLLED WARMUP AND RELATED METHOD

CLAIM OF PRIORITY

This application makes reference to, incorporates the same herein, and claims all benefits accruing under 35 U.S.C. §119 from an application for *WARMUP CONTROLLING METHOD OF AN IMAGE FORMING APPARATUS* earlier filed in the Korean Industrial Property Office on the 20th day of Oct. 1995 and there duly assigned Ser. No. 36344/1995.

BACKGROUND OF THE INVENTION

1. Field of the Invention

The present invention relates to an image forming apparatus and, more particularly, to an image forming apparatus equipped with a toner cartridge.

2. Description of the Related Art

When a malfunction (a malfunction such as a paper jam or depletion of the toner, or a failure of a component part inside the housing of the apparatus) occurs in the engine unit of an image forming apparatus such as a laser beam printer, a digital copy machine, etc., a user gains access to the inside of the housing by opening the cover of the image forming apparatus to identify and, if possible, correct the cause of the malfunction of the engine unit. After the user closes the cover of the image forming apparatus upon correcting the cause of the malfunction, an engine controlling unit of the image forming apparatus allows each part of the engine unit to warm up with a concomitant consumption of electrical energy, according to a predetermined program. Such a warm up process enables an developing unit and a sheet fixing unit's compression rollers to be in condition for a uniform, harmonious operation. Further, the warmup allows the gear of a toner cartridge to be correctly engaged with the gear of the engine unit when the supply of toner or developer is replenished in a developer container of the image forming apparatus. Due to the warmup procedure, it is not desirable for the user to frequently open the cover, except to remove jammed paper from the feeder unit or to refill toner in the developer housing.

When the user closes the cover of the apparatus after mending the malfunction of a certain part of the engine unit, the user does not always need to move the toner cartridge. If the toner cartridge is not moved, the engine unit does not have to be driven to engage the gear of the toner cartridge with the gear of the engine. In contemporary practice, an image forming apparatus goes through a warmup whenever the cover is returned from an opened state to a closed state, regardless of the movement of their toner cartridges. This disregard of the toner cartridge causes a waste of time and a waste of power consumption.

From my study of the contemporary practice, I believe that the contemporary practice does not appear to teach an effective image forming apparatus or an effective image forming method that reduces this waste of time and power consumption. Okada et al. (U.S. Pat. No. 5,476,469, *Image Forming Equipment with Depletion Detection in a Toner Endless Circulation Path*, Dec. 12, 1995) discusses detecting a depletion of the toners with respect to a toner delivery path. Hayashi et al. (U.S. Pat. No. 5,471,282, *Deposited Toner Quality Measuring Method and Image Forming Apparatus Using the Same*, Nov. 28, 1995) teaches its method of using sensor to detect condition of a toner in an image forming apparatus. Eguchi (U.S. Pat. No. 5,398,106, *Image Forming Apparatus Utilizing Replaceable Image Forming Cartridge and Detecting Means*, Mar. 14, 1995) teaches reducing the operation of the image forming apparatus and teaches detection of the presence of a replaceable image forming unit. Christensen et al. (U.S. Pat. No. 5,289,242, *Method and System for Identifying the Type of Toner Print Cartridges Loaded into Electrophotographic Printers*, Feb. 22, 1994) discusses detecting not only the presence of the toner cartridge but also the type of the toner cartridge. Kurando et al. (U.S. Pat. No. 5,184,181, *Cartridge Discriminating System*, Feb. 2, 1993) also teaches discriminating among cartridges. Sonoda et al. (U.S. Pat. No. 5,122,837, *Toner Cartridge for an Image Forming Apparatus*, Jun. 16, 1992) teaches a sensor that detects a toner cartridge. These exemplars of the contemporary practice appear to indicate that there is a need for an effective image forming apparatus or an effective image forming method that reduces this waste of time and power consumption by initiating a warmup only when necessary, such as for the toner cartridge is moved.

SUMMARY OF THE INVENTION

It is an object of the present invention to provide an improved image forming apparatus.

It is an object of the present invention to provide an improved image forming apparatus equipped with a toner cartridge.

It is an object of the present invention to provide a method for selectively controlling a warmup of an image forming apparatus according to whether a toner cartridge of the image forming apparatus is moved or not.

To realize one or more of the objects, the present invention discloses a method for controlling a warmup of an image forming apparatus with a first sensor used to detect if a cover of the apparatus is being opened or not. A second sensor is used to detect if a toner cartridge of the apparatus is moved or not. The method can include a step of, when the first sensor produces a signal informing the cover is being opened, determining whether the toner cartridge is moved in response to the signal. The method can also include the step of allowing the image forming apparatus to go through a warmup only when the second sensor produces a signal informing the movement of the toner cartridge.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

A preferred embodiment of the present invention is now described in detail with reference to the accompanying drawings.

Figure 1:
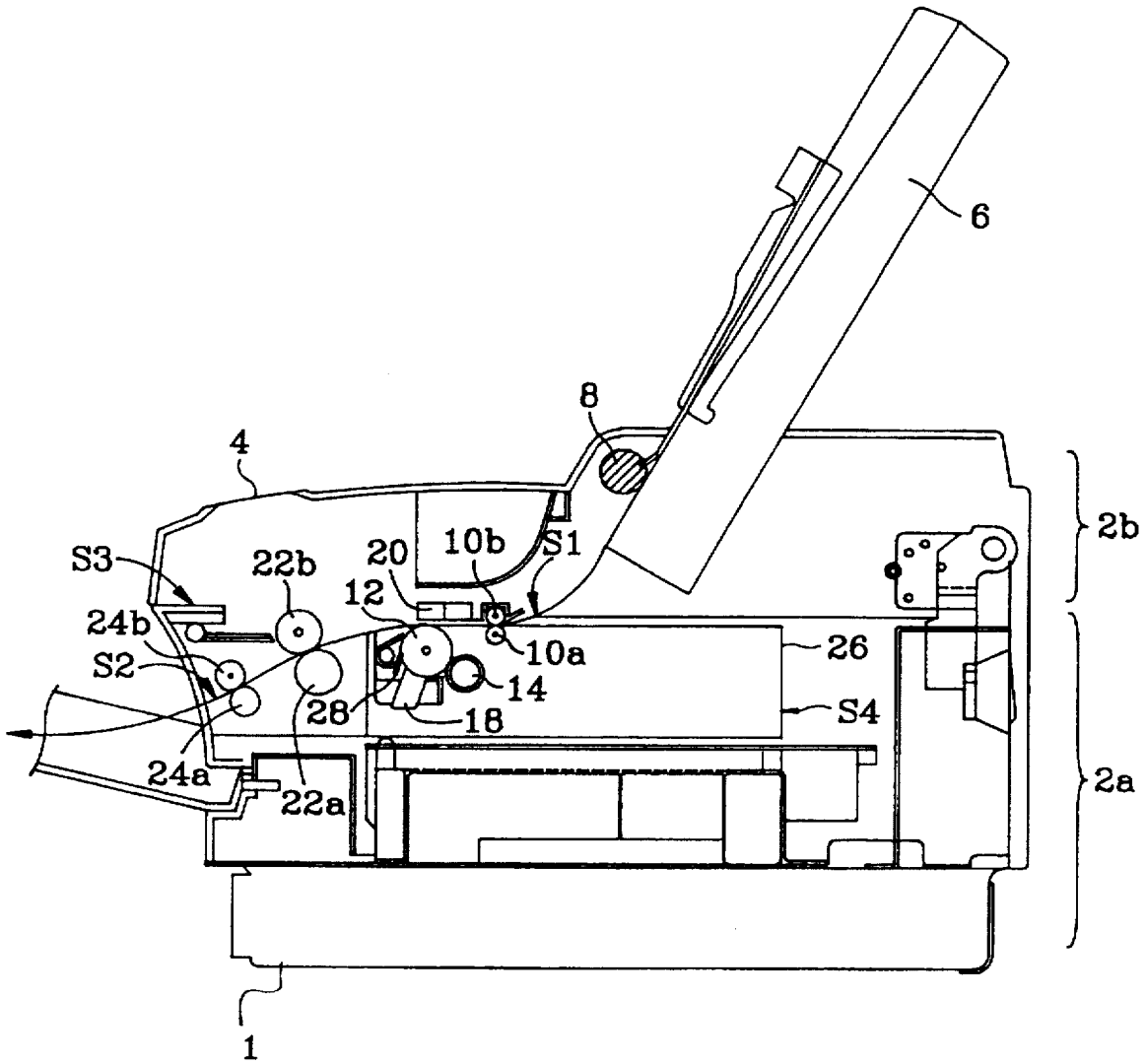
FIG. 1 is a schematic diagram depicting a laser beam printer employing a general electrophotographic process according to the principles of the present invention.

Turning now to the drawings, FIG. 1 illustrates using a schematic diagram, a laser beam printer 1. The printer 1 employs a mechanism for a general electrophotographic process.

The laser beam printer 1 includes a sensor S4 for sensing the movement of a toner cartridge and a toner cartridge 26. The laser beam printer of FIG. 1 has a housing 4 with a main body 2*a* and a cover 2*b*. The cover 2*b* can be pivoted downward. The cover 2*b* closes by pivoting towards the main body 2*a*. Inside of the housing 4, a charger 20 uniformly charges a surface of a photoconductive drum 12 to a predetermined polarity. Before scanning the surface of the photoconductive drum 12, a laser scanner unit 18 generates a laser beam corresponding to a pixel signal of image information input. Then, the surface of the photoconductive drum 12 is scanned with the laser beam from the laser scanner unit 18 using a laser reflecting mirror so that a latent image corresponding to image information is formed on the photoconductive drum 12. Using this latent image, a developing unit 14 creates a toner image. A transfer charger 20 transfers the toner image formed on the photoconductive drum 12 to the paper.

The paper comes from a sheet cassette 6. A sheet pickup roller 8 picks up a sheet of paper contained in the sheet cassette 6 and delivers it to registration rollers 10*a* and 10*b*. Due to this function, the sheet pickup roller 8 is also referred to as a sheet feeding roller. The registration rollers 10*a* and 10*b* serve to align the paper fed by the sheet pickup roller 8. To this paper, a transfer charger 20 transfers the toner image formed on the photoconductive drum 12. A cleaner 28 removes a residual toner on the surface of the photoconductive drum 12 after the toner image transfer.

This toner is fused to the paper. A fixing unit fuses the toner to the paper by heating. Typically, the fixing unit 22*a* and 22*b* includes a compression roller 22*a* and a heater roller 22*b*. The heater roller 22*b* is heated by a heater lamp (not shown) therein, so as to fuse the toner to the paper. The paper is discharged as an image-formed product to the outside of the printer, through sheet delivery rollers 24*a* and 24*b*.

The printer has a sensor for detecting the operating condition of each unit: the conveyance condition of paper, sheet discharging, the opened or closed state of the cover 2*b*, and the movement of the toner cartridge 26. FIG. 1 depicts first to fourth sensors S1 to S4 each for sensing the above condition and state. First sensor S1 mounted on the sheet conveyance path between the sheet pickup roller 8 and registration rollers 10*a* and 10*b* senses the sheet conveyance condition from the sheet cassette 6 to the registration rollers 10*a* and 10*b*. Second sensor S2 disposed on the sheet discharge path at the rear end of the sheet delivery rollers 24*a* and 24*b* detects the sheet discharging condition from the sheet delivery rollers 24*a* and 24*b*. Third sensor S3 disposed on one side of the cover 2*b* opposite to that of the main body 2*a*, senses the closing condition of the cover 2*b*. Fourth sensor S4 disposed on the rear end of the toner cartridge 26 in accordance with the present invention detects the movement of the toner cartridge 26.

Figure 2:
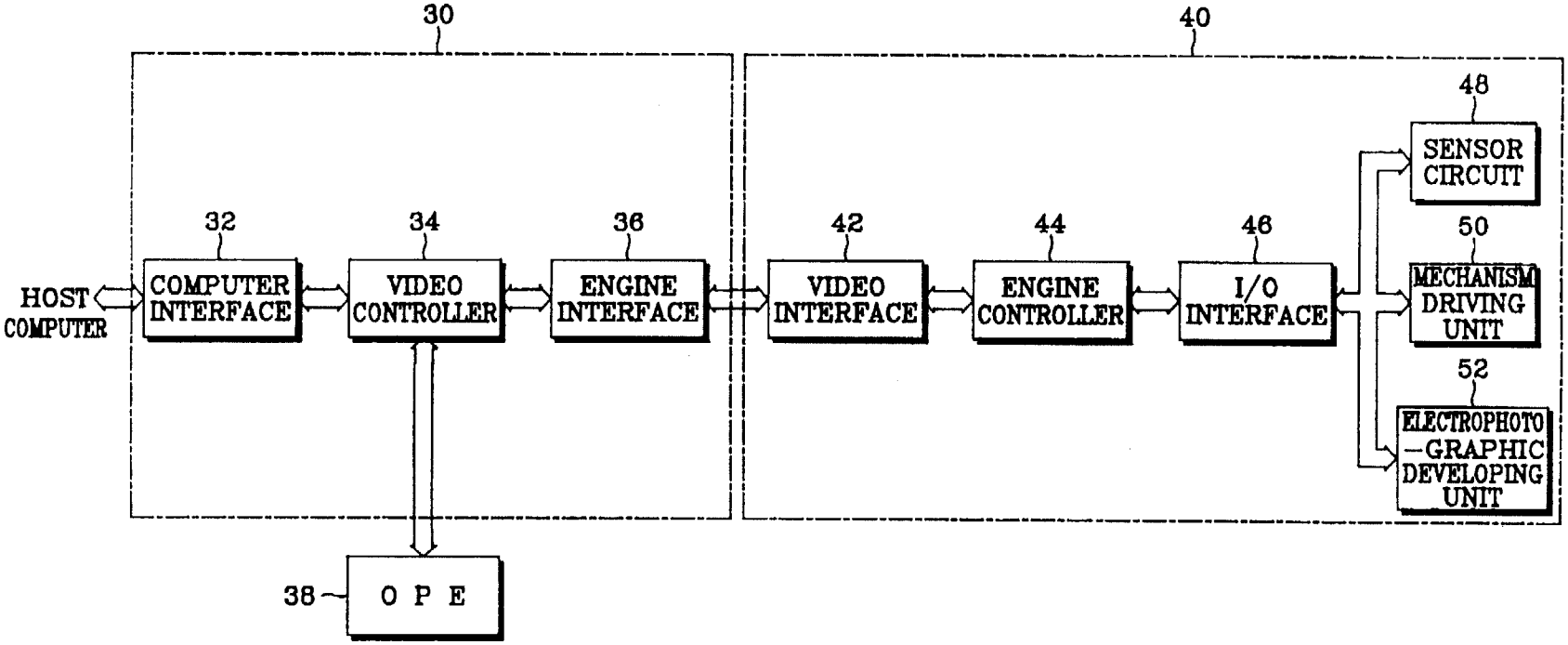
FIG. 2 is a block diagram illustrating operating units of a laser beam printer employing a general electrophotographic process according to the principles of the present invention.

FIG. 2 is a block diagram showing a general electrophotographic printer. This printer includes a video control circuit 30, a print engine unit 40, and an operating panel (OPE) 38.

The video control circuit 30 has a computer interface 32, a video controller 34, and an engine interface 36. The computer interface 32 communicates with a host computer for exchange of input and output signals (I/O signals). The video controller 34 converts image data produced from the computer interface 32 into image data that is processed by the print engine unit according to a predetermined program to transmit it to the print engine unit 40, and temporarily stores data produced from the host computer and OPE 38. The engine interface 36 communicating with the print engine unit 40 under the control of the video controller 34.

The OPE 38 has a plurality of keys used to input various instructions. The OPE 38 also has a display device used to display information derived from the operation of the printer.

The print engine unit 40 has a video interface 42, an engine controller 44, an input/output (I/O) interface 46, a sensor circuit 48, a mechanism driving unit 50 and an electrophotographic developing unit 52. This print engine unit 40 is connected to the video control circuit 30.

The video interface 42 allows the engine controller 44 to communicate with the video control circuit 30. Under this control of the video control circuit 30, the engine controller 44 in turn controls the mechanism driving unit 50 and the electrophotographic developing unit 52. By controlling the mechanism driving unit 50 and the electrophotographic developing unit 52, the engine controller 44 prints, on plain paper, toner image corresponding to image information transmitted from the video control circuit 30. Using the sensor circuit 48, the engine controller 44 checks the operating condition each part of the print engine unit 40 such as the movement of the parts, the sheet feeding, the sheet conveyance, and the amount of developer.

The I/O interface 46 connects the engine controller 44 to the sensor circuit 48, mechanism driving unit 50 and electrophotographic developing unit 52. The I/O interface 46 connects by conduiting (interfacing) the interface I/O signals of the engine controller 44. The sensor circuit 48 controls various sensors for the operating conditions and movements of the print engine unit 40's parts, the feeding or conveyance condition of paper, and the amount of developer.

The mechanism driving unit 50 drives various units used for sheet feeding, sheet conveyance, and printing. The electrophotographic developing unit 52 is controlled by the engine controller 44, and prints images corresponding to image information on paper by an electrophotographic process.

Figure 3:
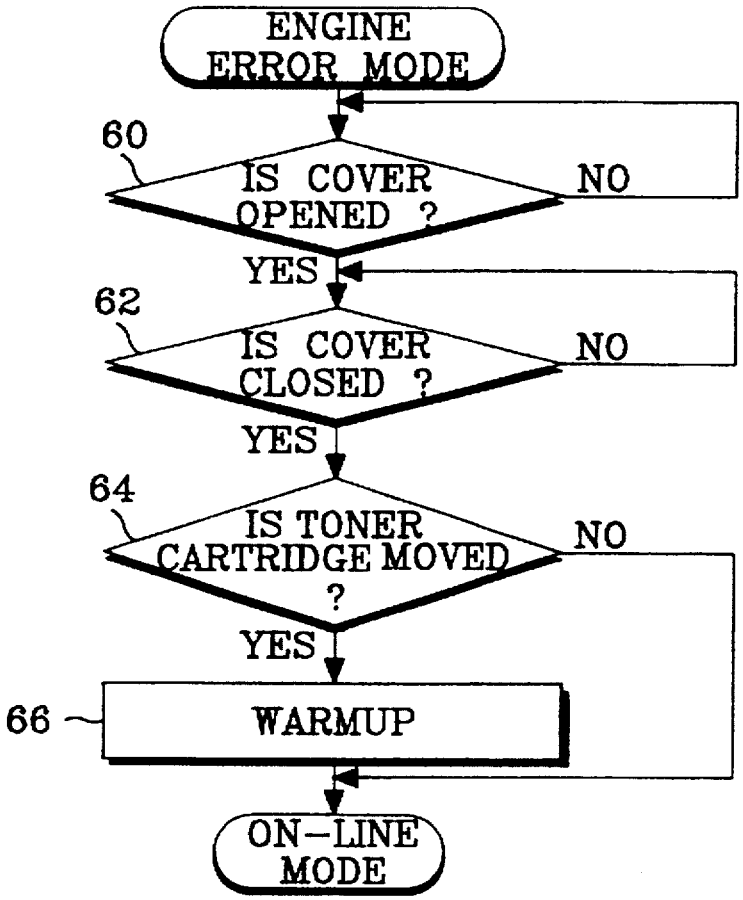
FIG. 3 is a flow chart showing the steps in an operation of the engine controller of a laser beam printer employing a general electrophotographic process according to the principles of the present invention.

FIG. 3 is a flow chart showing the operation of the print engine unit 40, especially the engine controller 44. As the operation of the present invention is described in detail, the following refers to FIGS. 1 and 2 as well as FIG. 3. If a malfunction or a lack occurs in a certain part of the print engine unit 40 (for example, if there is a need to refill a developer or a toner), a user opens the cover of the printer to eliminate the cause of the print engine unit 40's malfunction. At step 60, the engine controller 44 checks whether it receives a signal informing that the cover 2*b* is opened, from the third sensor S3 of the sensor circuit 48. At step 62, when the engine controller 44 receives the signal informing that the cover 2*b* is opened, the engine controller 44 determines whether it receives a signal informing that the cover 2*b* is closed from the third sensor of the sensor circuit 48. At step 64, when the engine controller 44 receives the signal informing that the cover 2*b* is closed, it determines whether it receives a signal informing the movement of the toner cartridge 26 from the fourth sensor S4 of the sensor circuit 48. At step 66, when the engine controller 44 receives the signal informing the movement of the toner cartridge 26 from the fourth sensor S4 of the sensor circuit 48, it executes a warmup to initialize each part of the print engine unit 40.

If the engine controller 44 does not receive the signal informing the movement of the toner cartridge 26 from the fourth sensor S4 of the sensor circuit 48, the engine controller 44 converts the state of each part of the print engine unit 40 into the turned-off state. This conversion is done according to a predetermined program which can execute the printing operation promptly in response to an instruction for printing. The instruction for printing can be input from outside.

As mentioned above, the present invention enables the image forming apparatus to selectively go through a warmup (selectively according to the state whether the toner cartridge is moved or not), whenever the cover of the image forming apparatus is opened and then closed. Because of this and other features, the present invention can reduce the unnecessary time and power consumption.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An image forming apparatus that goes through a warmup when a toner cartridge is moved, said image forming apparatus comprising:

a housing having a main body and a cover;

a sheet cassette disposed to contain paper;

a sheet pickup roller disposed to convey the paper from said sheet cassette;

first and second registration rollers disposed to align the paper from said sheet pickup roller;

first and second sheet delivery rollers disposed to discharge the paper;

the toner cartridge containing a toner for the paper;

a first sensor, mounted on a sheet conveyance path between said sheet pickup roller and said first and second registration rollers, said first sensor disposed to sense a sheet conveyance condition from the sheet cassette to said first and second registration rollers;

a second sensor disposed on a sheet discharge path at a rear end of said first and second sheet delivery rollers, said second sensor disposed to detect a sheet discharging condition from said first and second sheet delivery rollers;

a third sensor disposed on one side of the cover, said third sensor sensing whether the cover is open, closed, being opened, or being closed; and a fourth sensor located on a rear end of the toner cartridge, said fourth sensor detecting movement of the toner cartridge;

wherein, when said third sensor detects the cover being opened, said third sensor produces a first signal informing the cover is being opened;

wherein, in response to said third sensor producing the first signal, said fourth sensor detects whether said toner cartridge is being moved;

wherein, when said fourth sensor detects that said toner cartridge is being moved, said fourth sensor produces a second signal informing movement of the toner cartridge; and wherein said image forming apparatus goes through a warmup only when said fourth sensor produces the second signal informing the movement of the toner cartridge.

2. The image forming apparatus of claim 1, wherein the image forming apparatus comprises:

a video control circuit;

a print engine unit connected to said video control circuit; and an operating panel disposed to display information from said video control circuit.

3. The image forming apparatus of claim 2, wherein said video control circuit comprises:

a computer interface communicating with a host computer and disposed to produce first image data;

a video controller disposed to convert the first image data into second image data that can be processed by said print engine unit; and an engine interface controlled by said video controller, communicating with said print engine unit.

4. The image forming apparatus of claim 2, wherein said print engine unit comprises:

a video interface communicating with said video control unit;

an engine controller allowed by said video interface to communicate with said video control unit, checking operating conditions within the print engine unit;

an input/output interface connected to said engine controller, connecting said engine controller to input/output signals;

a sensor circuit connected to said input/output interface controlling sensors;

a mechanism driving unit connected to said input/output interface, driving mechanisms for sheet feeding, conveyance, and printing; and an electrophotographic developing unit connected to said input/output interface, printing images by an electrophotographic process.

5. A method for controlling a warmup of an image forming apparatus having a first sensing mechanism sensing if a cover of said apparatus is being opened or not and a second mechanism sensing if a toner cartridge of said apparatus is moved or not, said method comprising the steps of:

when said first mechanism produces a first signal informing the cover is being opened, determining if said toner cartridge is moved in response to said first signal; and allowing said image forming apparatus to go through a warmup only when said second mechanism produces a second signal informing the movement of the toner cartridge.

6. The method of claim 5, wherein the image forming apparatus comprises:

a housing having a main body and the cover;

a sheet cassette disposed to contain paper;

a sheet pickup roller disposed to convey the paper from said sheet cassette;

first and second registration rollers disposed to align the paper from said sheet pickup roller;

first and second sheet delivery rollers disposed to discharge the paper;

the toner cartridge containing a toner for the paper;

a first sensor, mounted on a sheet conveyance path between said sheet pickup roller and said first and second registration rollers, said first sensor disposed to sense a sheet conveyance condition from the sheet cassette to said first and second registration rollers;

a second sensor disposed on a sheet discharge path at a rear end of said first and second sheet delivery rollers, said second sensor disposed to detect a sheet discharging condition from said first and second sheet delivery rollers;

a third sensor disposed on one side of the cover, said third sensor sensing whether the cover is open, closed, being opened, or being closed; and a fourth sensor located on a rear end of the toner cartridge, said fourth sensor detecting movement of the toner cartridge.

7. The method of claim 5, wherein the image forming apparatus comprises:

a video control circuit;

a print engine unit connected to said video control circuit; and an operating panel disposed to display information from said video control circuit.

8. The method of claim 7, wherein said video control circuit comprises:

a computer interface communicating with a host computer and disposed to produce first image data;

a video controller disposed to convert the first image data into second image data that can be processed by said print engine unit; and an engine interface controlled by said video controller, communicating with said print engine unit.

9. The method of claim 7, wherein said print engine unit comprises:

a video interface communicating with said video control unit;

an engine controller allowed by said video interface to communicate with said video control unit, checking operating conditions within the print engine unit;

an input/output interface connected to said engine controller, connecting said engine controller to input/output signals;

a sensor circuit connected to said input/output interface controlling sensors;

a mechanism driving unit connected to said input/output interface, driving mechanisms for sheet feeding, conveyance, and printing; and an electrophotographic developing unit connected to said input/output interface, printing images by an electrophotographic process.

10. A method for controlling a warmup of an image forming apparatus, comprised of:

making a first determination on a basis of a first signal from a first sensor of whether a cover of the apparatus is being opened;

making a second and independent determination on a basis of an output signal from a second sensor located at a position spaced-apart from said first sensor of whether a toner cartridge within the apparatus is being moved;

when said first determination indicates that the cover is being opened, making said second determination; and initiating a thermal warm-up of said image forming apparatus only after said second determination establishes that the toner cartridge is being moved.

11. The method of claim 10, comprised of initiating said thermal warm-up only after said first determination establishes that the cover is being opened and said second determination establishes that the toner cartridge is being moved.

12. The method of claim 11, comprised of initiating said warm-up only after said cover has been closed.

13. The method of claim 10, wherein the image forming apparatus comprises:

a video control circuit;

a print engine unit connected to said video control circuit; and an operating panel disposed to display information from said video control circuit.

14. An image forming apparatus that goes through a warmup when a toner cartridge is moved, said image forming apparatus comprising:

a housing having a main body and a cover;

conveying means for conveying a sheet along a conveying path;

first sensor means disposed on said cover for sensing when said cover is being opened, and for producing a first signal informing that said cover is being opened; and second sensor means located on the toner cartridge for detecting movement of the toner cartridge and for producing a second signal informing that the toner cartridge is being moved;

wherein, when said first sensor means produces said first signal informing that said cover is being opened, said second sensor means is activated to detect whether said toner cartridge is being moved; and wherein, when said second sensor means detects that said toner cartridge is being moved at the same time that said first sensor means is producing said first signal, said second sensor means produces a second signal;

said apparatus further comprising warmup means responsive to said second signal from said second sensor means for warming up said apparatus only when said second sensor means produces said second signal.

15. The image forming apparatus of claim 14, wherein the image forming apparatus comprises:

a video control circuit;

a print engine unit connected to said video control circuit; and an operating panel disposed to display information from said video control circuit.

16. The image forming apparatus of claim 14, wherein said video control circuit comprises:

a computer interface communicating with a host computer and disposed to produce first image data;

a video controller disposed to convert the first image data into second image data that can be processed by said print engine unit; and an engine interface controlled by said video controller, communicating with said print engine unit.

17. The image forming apparatus of claim 14, further comprising third sensor means disposed on said sheet conveyance path for sensing a sheet conveyance condition of said apparatus.

18. The image forming apparatus of claim 17, further comprising fourth sensor means disposed on a sheet discharge path for detecting a sheet discharging condition of said apparatus.

19. The image forming apparatus of claim 14, further comprising third sensor means disposed on a sheet discharge path for detecting a sheet discharging condition of said apparatus.

* * * * *